US006122805A

United States Patent [19]

Haegley

[11] Patent Number: 6,122,805

[45] Date of Patent: Sep. 26, 2000

[54] DEVICE FOR SECURING RIBBONS TO MILITARY UNIFORM

[75] Inventor: Daryl Regan Haegley, Westminster, Md.

[73] Assignee: Daryl R. Haegley, Westminster, Md.

[21] Appl. No.: 09/268,151

[22] Filed: Mar. 15, 1999

[51] Int. Cl.[7] ..... A44B 1/32; A44C 3/00; G09F 3/08

[52] U.S. Cl. ..... 24/114.4; 24/114.05; 24/13; 40/1.5

[58] Field of Search ..... 24/114.4, 114.05, 24/114.12, 13; 40/1.5

[56] References Cited

U.S. PATENT DOCUMENTS

| | | | |
|---|---|---|---|
| 520,621 | 5/1894 | Stowe | 24/114.4 |
| 1,176,025 | 3/1916 | Bohlim | 24/13 |
| 1,183,392 | 5/1916 | Meek | 24/13 |
| 1,624,458 | 4/1927 | Zook | 24/13 |
| 1,690,129 | 11/1928 | Prentiss | 24/114.4 |
| 2,058,020 | 10/1936 | Jaffe | 24/114.4 |
| 2,832,161 | 4/1958 | Murphy | 40/1.5 |
| 2,902,782 | 9/1959 | Coleman | 40/1.5 |
| 3,009,381 | 11/1961 | Rapata | 24/114.4 |
| 3,088,295 | 5/1963 | Haines | 24/13 |
| 3,546,797 | 12/1970 | Oleson | 40/1.5 |
| 3,735,447 | 5/1973 | Abraham | 24/114.05 |
| 3,942,273 | 3/1976 | Adams | 40/1.5 |
| 4,137,657 | 2/1979 | Wardle | 40/1.5 |
| 4,344,240 | 8/1982 | Schiller | 24/114.05 |
| 4,813,110 | 3/1989 | Schiller | 24/114.05 |
| 5,441,188 | 8/1995 | Rosenstein | 24/13 |

*Primary Examiner*—Victor N. Sakran

[57] ABSTRACT

A securing device to be located on the inside of a uniform garment will accurately align and anchor military-type ribbon holders, nametags and warfare insignias. The securing device contains claps encased within a thin, soft, pliable plastic foam material sized slightly larger than the secured military-type ribbon holders, nametags and warfare insignias, yielding a flush appearance against the wearer's body. Repeated insertion to and retraction from my device can occur without concern for lost clasps or skin penetration.

1 Claim, 2 Drawing Sheets

DEVICE FOR SECURING RIBBONS TO MILITARY UNIFORM

CROSS-REFERENCE TO RELATED APPLICATIONS

U.S. Pat. No. 1,690,129 November, 1928 Prentiss . . . 24/90 R

U.S. Pat. No. 2,551,196 May, 1951 Ballou, Jr . . . 24/90 R

U.S. Pat. No. 2,832,161 August, 1957 Murphy . . . 24/90 R

U.S. Pat. No. 3,009,381 November, 1957 Rapata . . . 24/90 R

U.S. Pat. No. 3,942,273 March, 1976 Adams . . . 24/90 R

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

The field of the invention is a multi-size device for accurately aligning and securing military ribbons to the uniform. Two products are currently used to secure ribbons to military uniforms:

1. Ribbon Holder: This device is worn outside of the uniform material, typically a shirt or jacket. It is constructed of interconnected thin strips of metal (approximately 10 cm) designed to run horizontally across the uniform, accommodating proper standardized ribbon placement and alignment. From one to eight metal pins stem from the holder device and are designed to puncture the uniform material, affording the opportunity to secure the ribbon holder against the material by utilizing small metal clasps.
2. Metal Clasp: A small (approximately 5 mm), circular metal object with a hole on its flat side to accommodate one of the Ribbon Holder's metal pins. Thin metal tensioned on its other side secures the metal pin once inserted. Each metal pin that punctures the material requires a Metal Clasp.

Presently, the small clasps designed to secure the devices to the uniform frequently dislodge, during normal wear (exposing sharp metal points, which can scratch or penetrate the skin). This also produces a sloppy, nonmilitary, air-gap between the ribbons and other warfare insignia.

My invention will eliminate the need for non-attached individual clasps, as the clasps themselves will be integrated into a soft, pliable plastic foam device that exactly matches the corresponding number of pins (and their placement) that protrude from the ribbon holder. The unsightly air-gaps will also be eliminated.

BRIEF SUMMARY OF THE INVENTION

Awards and citations are presented to Military/Police personnel in the form of colorful medals and ribbons. Once awarded, those personnel are authorized to display the medals and ribbons on their uniform shirt or jacket. Government regulations dictate specific standards for wearing those awards, ensuring a standard, uniform display. In order to maintain the proper alignment on a uniform, ribbon holders have been created that can hold any number of ribbons. The holder secures the ribbons on to the outside of the shirt/jacket material by the use of metal pins, which penetrate the material. The holder is secured on the inside of the material with small metal clasps. During a career, individuals may accrue any number of ribbons, medals and insignias. Ribbon holders are available in many sizes to accommodate receipt of new awards. My invention is made to match any size of the ribbon device options. It will ensure proper alignment of the ribbon display and alleviate unsightly gaps between the ribbon holder and the uniform.

BRIEF DESCRIPTION OF THE SEVERAL VIEWS OF THE DRAWINGS

My figures have been re-drawn to provide clarification to previous drawings.

DETAILED DESCRIPTION OF THE INVENTION

Referring now specifically to the drawings, the numeral 3 generally designates the device of the present invention which is mounted on the inside of an article of outer wear 2 such as a uniform shirt but which may be mounted on the inside of any outer uniform garment.

Figure 1:
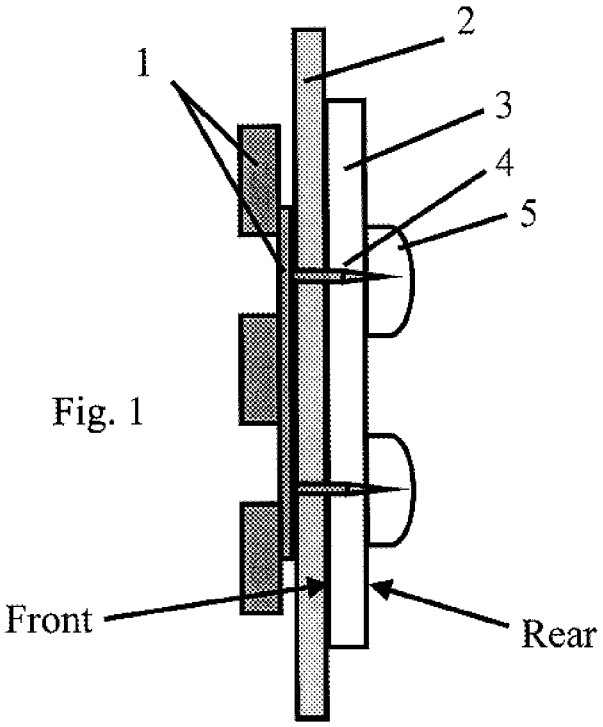
FIG. 1 is a perspective view of the securing device of the present invention fastened to military ribbon holder.
Figure 2:
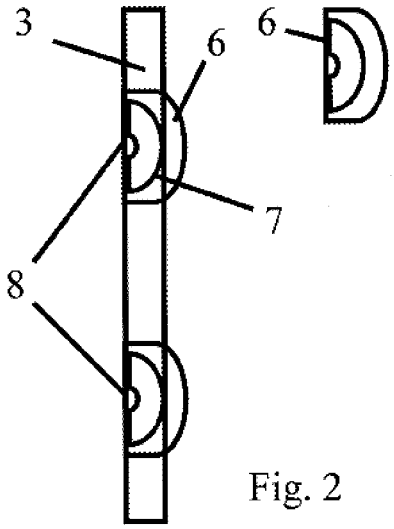
FIG. 2 is a sectional view of the securing device.

FIG. 1 contains an illustrated side view of a military ribbon holder 1. This type of military ribbon holder 1 is a known type in that it is the type illustrated and described in patent U.S. Pat. No. 3,942,273 to T. D. Adams, issued Mar. 09, 1976. A thin uniform material 2 is shown between the ribbon holder 1 and my securing device 3.

The pin 4 of the military ribbon holder 1 protrudes into the clasp device 6, via openings 8 through the uniform material 2.

In the front surface of the securing device 3 there exist depressions or openings 8 for receiving heads of pointed fasteners or pins similar to thumb tacks 4, received by an anchor or clasp device generally designated by 6 which includes a pair of squeeze tabs 7 which are resilient in nature and which when squeezed together will form an opening for receiving pointed fastener 4 and which when released will frictionally grip same. This type of fastener is a known type in that it is the type illustrated and described in patent U.S. Pat. No. 2,551,196 to F. A. Ballou, Jr., issued May 01, 1951.

Figure 3:
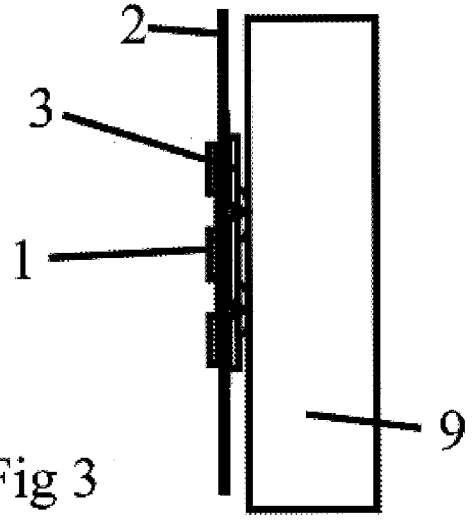
FIG. 3 is a group perspective of a military ribbon device worn with the securing device against the body of an individual.
Figure 4:
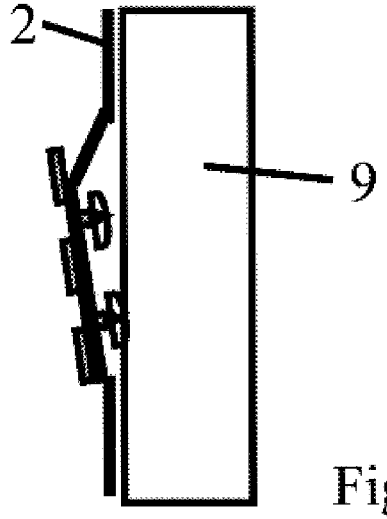
FIG. 4 is a group perspective of a military ribbon device worn against the body of an individual without the securing device.
Figure 5:
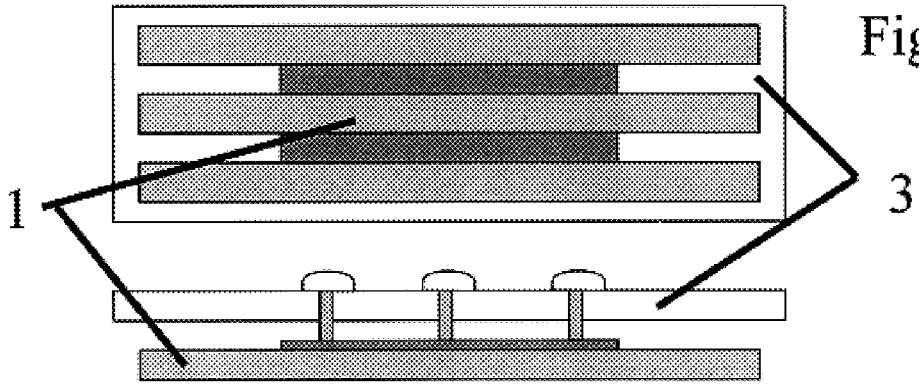
FIG. 5 is a group front and top perspective view of a military ribbon holder against the securing device.

These fasteners 6 are permanently imbedded into my securing device 3, enabling for a single integrated, protective, supporting and professional device that can be put in place or removed without fear clasp 6 dislodging and/or exposing the pointed pin 4 to individual body and/or skin 9. The securing device is sized slightly larger (approximately 3–5 millimeters) than the area of the secured military-type ribbon holders, nametags and warfare insignias, yielding a flush appearance against the wearer's body. FIG. 3 depicts the advantage of my device as it prevents the unsightly, unprofessional appearance of the uniform shirt as shown in FIG. 4. Current inventions do not ensure an even distribution of the military ribbon holder 1 displaying its ribbons against an individual's body/skin 9. FIG. 5 depicts a front and top view of my securing device 3 sized slightly larger (3–5 mm) than a military ribbon holder 1.

My application provides a device that contains a distinct, unique advantage to previous prior-art designs. My device provides firm functional improvement over previous claims by incorporating clasping devices into a non-specific soft, thin pliable plastic rubber foam material, at precise locations that match exactly pins allowing for multiple applications of insertion and removal.

It is this combination of inseparable supporting material and anchoring clasps, for the purpose of properly aligning the decorative devices and at the same time eliminating the device's projection away from the individual wearer, that makes this patent application unique.

Murphy's and Adam's patents are described in my application to illustrate the type of device my device would connect to. Further, Murphy depicts a plastic nut that secures the metal shaft protruding from the ribbon holder device. A fastening device of the like does not stay secured upon routine wear and leaves a gap between the individual's body (skin or shirt) resulting in an unsightly projection of the uniform area displaying insignia or the like devices. My device eliminates that gap with a thin, soft pliable plastic foam material providing integrated fastening devices that can be reused without concern for dislodgment, or concern for injury to skin or material.

Although both Parentis and Rapata disclose fastening device assemblies for securing insignia, identification, ornamental, nameplate and the like to service uniforms comprising of a plate member having a plurality of built-in clasps, however; Parentis discloses three separate and separable parts: head, background and base. My application constitutes an inseparable integration of two parts, comprising one functional device containing clasps within soft, thin, pliable foam rubber material. Daily application of one vice several parts adds to the unique advantage of my invention.

Rapata discloses devices that are permanently fixed once applied. Additionally, the securing pins described are exposed through the assembled material. The intent of my device is to ensure readily removable application and prevent shank/pin/shaft exposure.

I recognized the need for this invention while in the process of placing my own military ribbons and warfare insignia devices on my uniform shirt. And, in discussions with fellow officers, I came to the conclusion that my problem with the procedure was universal. Presently, the small clasps designed to secure the devices to the uniform frequently dislodge, during normal wear (exposing sharp metal points, which can scratch or penetrate the skin). This also produces a sloppy, non-military, air-gap between the ribbons and other warfare insignia. In order to try to alleviate these problems, I would create, from a thin piece of cardboard, a "support device" that I placed on the inside of my uniform shirt. This was cut to size 1 mm beyond the boundary of the ribbon holder, thus eliminating the unsightly air-gaps and assisting in protecting my chest from sharp pins. Additionally, the cardboard "support device" ensured proper alignment of my assigned medals and insignia (which is currently accomplished through visual estimations). As I earned additional awards, I would create a new and larger sized ribbon device to support the larger display pattern. Thinking of a better way, I envisioned a flexible, uniform, properly sized supporting device that would remain secure through clasps enclosed within the device's pliable plastic foam material. My invention can be pre-formed or adjusted to fit the standardized ribbon, nametag and insignia devices (or device set) authorized by the US military. My invention is comprised of a pliable, approximately 2–3 mm thick plastic foam material that incorporates the required number of clasps enclosed within the material. This is a new item as it provides a convenient, professional and uniform product that replaces non-uniform makeshift supporting devices, while at the same time promoting safety by preventing exposure of the sharp metal pins.

What is claimed is:

1. A single integrated securing device comprising a plurality of clasps imbedded into a soft pliable plastic foam material formed in a rectangular plate shaped slightly larger than a military ribbon, insignia or nametag holder device and their corresponding metal pins;

placement of said clasps within said plastic foam material will exactly align to receive said metal pins from the inside of a military uniform where in said device is adapted to evenly distributing said military ribbons, nametag, military display against garment of said military uniform for eliminating or preventing exposure of the sharp end of said metal pins and keep said pins away from the individual wearer; said securing device is adapted to secure a multiple of rows of clasps for receiving the pins of a multiple rows of ribbons and or insignia devices.

* * * * *